US012448161B2

(12) United States Patent
Nagashima et al.

(10) Patent No.: US 12,448,161 B2
(45) Date of Patent: Oct. 21, 2025

(54) BAGMAKING AND PACKAGING APPARATUS

(71) Applicant: ISHIDA CO., LTD., Kyoto (JP)

(72) Inventors: Ryota Nagashima, Ritto (JP); Satoshi Hashimoto, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 16 days.

(21) Appl. No.: 18/508,243

(22) Filed: Nov. 14, 2023

(65) Prior Publication Data

US 2024/0190597 A1 Jun. 13, 2024

(30) Foreign Application Priority Data

Dec. 8, 2022 (JP) ..... 2022-196189

(51) Int. Cl.
*B65B 9/20* (2012.01)
*B65B 41/16* (2006.01)
*B65B 51/30* (2006.01)

(52) U.S. Cl.
CPC ..... *B65B 9/20* (2013.01); *B65B 41/16* (2013.01); *B65B 51/30* (2013.01); *B65B 2210/06* (2013.01)

(58) Field of Classification Search
CPC ..... B65B 9/20; B65B 41/16; B65B 51/30; B65B 2210/06
See application file for complete search history.

(56) References Cited

U.S. PATENT DOCUMENTS 3,488,914 A * 1/1970 Csernak ..... B29C 66/8242 53/511
6,619,018 B1 * 9/2003 Sasaki ..... B65B 31/045 53/511
11,066,196 B2 * 7/2021 Kageyama ..... B65B 59/04
(Continued)

FOREIGN PATENT DOCUMENTS

AU 2018204221 A1 1/2019
AU 2022201663 A1 9/2022
(Continued)

OTHER PUBLICATIONS

Extended European Search Report dated May 7, 2024, issued in connection with related European Application 232100003.2-1014.

*Primary Examiner* — Andrew M Tecco
*Assistant Examiner* — Nicholas E Igbokwe
(74) *Attorney, Agent, or Firm* — United IP Counselors, LLC

(57) ABSTRACT

A bagmaking and packaging apparatus includes a film conveyance mechanism, a former mechanism, a transverse sealing mechanism, and a first partition member. The film conveyance mechanism conveys a film. The former mechanism includes a product feed chute and a former. The product feed chute has a product fed to it. The former forms in a tubular shape the film conveyed by the film conveyance mechanism. The transverse sealing mechanism is disposed under the former mechanism. The transverse sealing mechanism transversely seals the tubular film to make bags containing the product fed from the product feed chute. The first partition member partitions a space around the former mechanism into a first space and a second space. The first space is on the product feed chute side. The second space is on the transverse sealing mechanism side.

8 Claims, 4 Drawing Sheets

(56) References Cited

U.S. PATENT DOCUMENTS

| | | | | |
|---|---|---|---|---|
| 2003/0093971 | A1* | 5/2003 | Terminella | B29C 66/849 53/133.4 |
| 2005/0066629 | A1* | 3/2005 | Taylor | B65B 9/22 53/551 |
| 2012/0198799 | A1* | 8/2012 | Nishitsuji | B65B 37/18 53/551 |
| 2019/0009936 | A1* | 1/2019 | Otxoa-Aizpurua Calvo | B65B 51/26 |
| 2019/0152638 | A1* | 5/2019 | Nakamura | B65B 59/04 |
| 2021/0155356 | A1* | 5/2021 | Boccolari | B65B 55/08 |

FOREIGN PATENT DOCUMENTS

| | | | |
|---|---|---|---|
| EP | 3461749 | A2 | 4/2019 |
| JP | 2002-337817 | A | 11/2002 |

* cited by examiner

BAGMAKING AND PACKAGING APPARATUS

CROSS-REFERENCE TO RELATED APPLICATIONS

This application is based on and claims the priority benefit of Japanese patent application 2022-196189 filed Dec. 8, 2022, the contents of which are incorporated herein by reference.

TECHNICAL FIELD

The claimed invention relates to a bagmaking and packaging apparatus.

BACKGROUND ART

Bagmaking and packaging apparatus are known which, as in patent document 1 (JP-A No. 2002-337817), drop a product into a film formed in a tubular shape by a former and seal the film to make bags.

Among products packed in bags by such bagmaking and packaging apparatus, there are products that include powdery matter as well as fine matter with a low specific gravity. For example, in a case where potato chips are the product, tiny matter such as fine chip fragments and seasoning particles are included in the product.

In the case of making bags filled with a product that includes such tiny matter as described above, the tiny matter scatters from the former and deposits on devices disposed under the former.

SUMMARY OF THE CLAIMED INVENTION

A bagmaking and packaging apparatus in accordance with the claimed invention has excellent cleanability.

A bagmaking and packaging apparatus pertaining to a first aspect of the claimed invention includes a film conveyance mechanism, a former mechanism, a transverse sealing mechanism, and a first partition member. The film conveyance mechanism conveys a film. The former mechanism includes a product feed chute and a former. The product feed chute has a product fed to it. The former forms in a tubular shape the film conveyed by the film conveyance mechanism. The transverse sealing mechanism is disposed under the former mechanism. The transverse sealing mechanism transversely seals the tubular film to make bags containing the product fed from the product feed chute. The first partition member partitions a space around the former mechanism into a first space and a second space. The first space is on the product feed chute side. The second space is on the transverse sealing mechanism side.

The bagmaking and packaging apparatus pertaining to the first aspect of the claimed invention has the first partition member that partitions the space around the former mechanism into the first space and the second space. For that reason, seasoning particles can be inhibited from getting into units disposed under the former mechanism. As a result, cleanability is enhanced.

A bagmaking and packaging apparatus pertaining to a second aspect of the claimed invention is the bagmaking and packaging apparatus pertaining to the first aspect, wherein the former mechanism has a former base. The former base has the product feed chute and the former attached to it. The former base is attached to the first partition member.

In the bagmaking and packaging apparatus of the second aspect, the former base can be used as a reference when attaching the former mechanism, so it becomes easy to position the former relative to the first partition member (attachment surface).

A bagmaking and packaging apparatus pertaining to a third aspect of the claimed invention is the bagmaking and packaging apparatus of the first aspect or the second aspect, wherein an upper surface of the first partition member is flat.

In the bagmaking and packaging apparatus of the third aspect, there is no unevenness in the upper surface of the first partition member, so cleanability is further enhanced.

A bagmaking and packaging apparatus pertaining to a fourth aspect of the claimed invention is the bagmaking and packaging apparatus of any of the first aspect to the third aspect, further including a cover. The cover has a door. The cover surrounds the former mechanism in a vertical direction. A part of the first partition member is provided on the door.

In the bagmaking and packaging apparatus of the fourth aspect, the part of the first partition member moves together with the door, so maintainability is excellent.

A bagmaking and packaging apparatus pertaining to a fifth aspect of the claimed invention is the bagmaking and packaging apparatus of the fourth aspect, wherein the cover is provided with an opening.

In the bagmaking and packaging apparatus of the fifth aspect, it becomes possible to perform cleaning work by means of air through the opening.

A bagmaking and packaging apparatus pertaining to a sixth aspect of the claimed invention further includes air outlets for cleaning.

In the bagmaking and packaging apparatus of the sixth aspect, automatic cleaning becomes possible.

A bagmaking and packaging apparatus pertaining to a seventh aspect of the claimed invention is the bagmaking and packaging apparatus of any of the first aspect to the sixth aspect, further including a film supply mechanism. The film supply mechanism holds a film roll and supplies the film. A control unit is disposed under the film supply mechanism. The bagmaking and packaging apparatus has a second partition member. The second partition member partitions the second space between the film supply mechanism and the control unit into a third space and a fourth space. The third space is on the film supply mechanism side. The fourth space is on the control unit side.

In the bagmaking and packaging apparatus of the seventh aspect, seasoning particles can be prevented from falling onto the control unit.

A bagmaking and packaging apparatus pertaining to an eighth aspect of the claimed invention is the bagmaking and packaging apparatus of the seventh aspect, wherein an upper surface of the second partition member is flat.

In the bagmaking and packaging apparatus of the eighth aspect, there is no unevenness in the upper surface of the second partition member, so cleanability is enhanced.

According to the claimed invention, there can be provided a bagmaking and packaging apparatus that has excellent cleanability.

DESCRIPTION OF EMBODIMENTS

Figure 1:
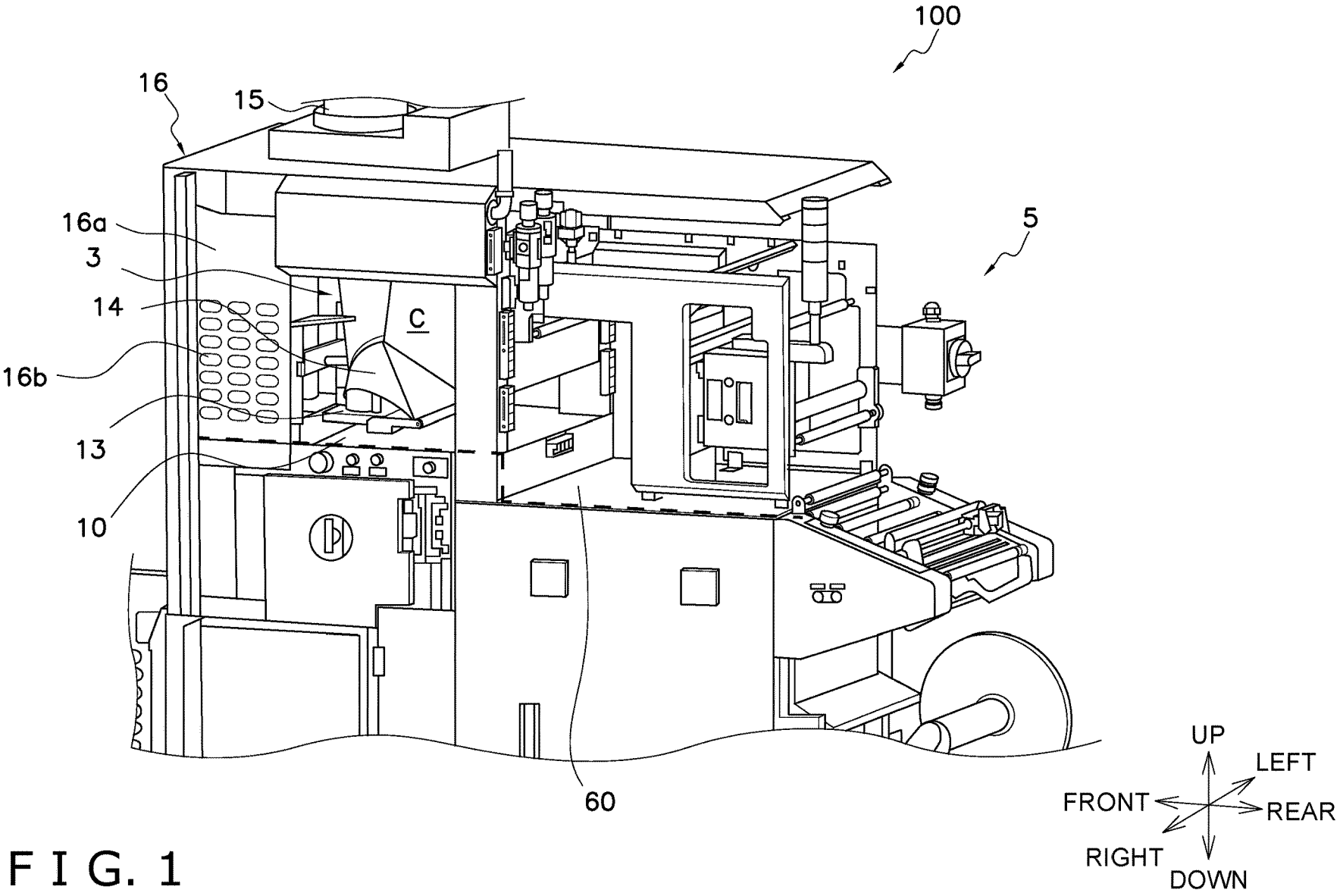
FIG. 1 is a schematic perspective view of a bagmaking and packaging apparatus in accordance with the claimed invention.

An embodiment of a bagmaking and packaging apparatus in accordance with the claimed invention will now be described with reference to the drawings. It will be noted that the following description is merely a specific example of the claimed invention and is not intended to limit the technical scope of the claimed invention. It will be understood that various changes in form and detail may be made without departing from the spirit and scope of the claimed invention as set forth in the claims.

In the following description, there are cases where expressions such as horizontal, vertical, flat, and parallel are used, and these include not only cases where that which they describe are completely horizontal, vertical, flat, or parallel but also cases where that which they describe are substantially horizontal, vertical, flat, or parallel.

Furthermore, in the following description, there are cases where, for convenience of description, expressions such as "front (in front of)." "rear (in back of)." "upper," "lower," "left," and "right" are used to indicate directions. Unless otherwise specified, these directional expressions refer to the directions of the arrows appearing in the drawings.

(1) Bagmaking and Packaging Apparatus

A bagmaking and packaging apparatus 100 is what is known as a vertical pillow packaging apparatus that performs bagmaking and packaging by feeding a product P supplied from above to the inside of a tubular bag, in which a film F has been formed in a tubular shape, and transversely sealing the top and bottom of the tubular bag.

Figure 2:
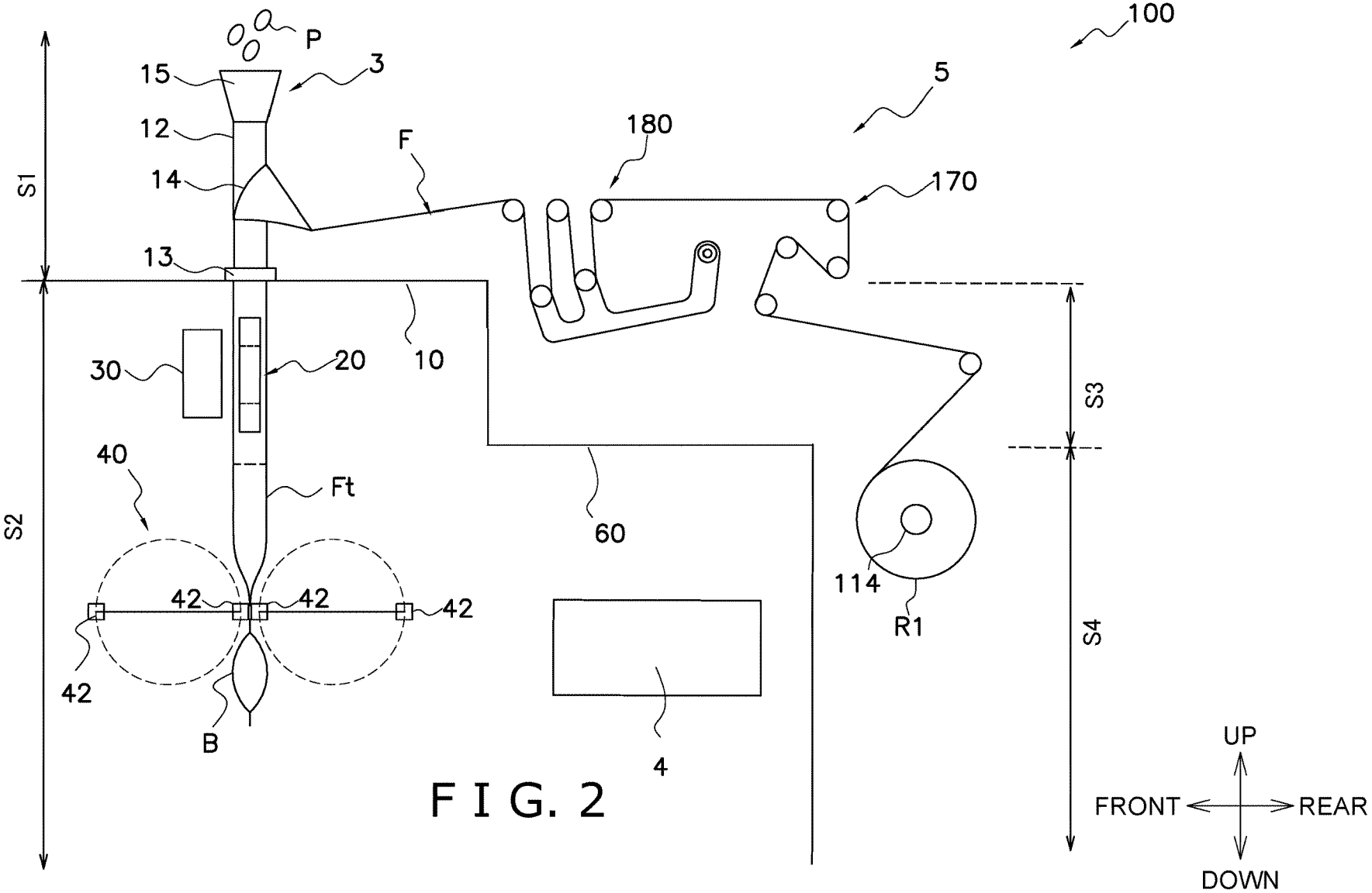
FIG. 2 is a diagram showing the schematic configuration of the bagmaking and packaging apparatus of FIG. 1.

As shown in FIG. 1 and FIG. 2, the bagmaking and packaging apparatus 100 includes a film conveyance mechanism 20, a former mechanism 3, a longitudinal sealing mechanism 30, a transverse sealing mechanism 40, a first partition member 10, a cover 16, a film supply mechanism 5, a control unit 4, and a second partition member 60.

(1-1) Former Mechanism

The former mechanism 3 receives a supply of the product P and forms in a tubular shape the sheet-like film F supplied from the film supply mechanism 5.

The former mechanism 3 includes a product feed chute 15, a tube 12, a former 14, and a former base 13.

The product feed chute 15 has the product P fed to it through an opening in the upper portion thereof. The product feed chute 15 receives the supply of the product P from, for example, a combination weigher (not shown in the drawings) disposed above it. The combination weigher uses plural weigh hoppers to measure a predetermined weight of the product P (e.g., potato chips) and supplies the product P to the opening in the upper portion of the product feed chute 15.

The tube 12 is a tubular member that extends in the up and down direction, and upper and lower ends of the tube 12 are open. The product feed chute 15 is disposed in, and the product P supplied by the combination weigher is fed to, the opening in the upper end of the tube 12.

The former 14 is disposed so as to surround the tube 12. The former 14 forms in a tubular shape the sheet-like film F supplied from the film supply mechanism 5 to form a tubular film Ft in which end portions of the film F in a direction orthogonal to the conveyance direction overlap each other.

The former base 13 is a tabular member. The former base 13 is disposed under the former 14. The former 14 and the tube 12 are secured to the former base 13. In the central portion of the former base 13 is formed a through hole (not shown in the drawings) through which the tube 12 is inserted.

The former base 13 is attached to the first partition member 10 described later. Specifically, the former base 13 is attached to the first partition member 10 in such a way that a bottom surface of the former base 13 is in contact with an upper surface of the first partition member 10.

(1-2) Film Conveyance Mechanism

The film conveyance mechanism 20 conveys the film F supplied from the film supply mechanism 5. Specifically, the film conveyance mechanism 20 uses a pair of belts (not shown in the drawings) having a suction function to hold and convey the tubular film Ft downward, thereby conveying the tubular film Ft and the upstream sheet-like film F.

The film conveyance mechanism 20 is disposed under the former mechanism 3. More specifically, the film conveyance mechanism 20 is disposed under the former base 13 of the former mechanism 3.

(1-3) Longitudinal Sealing Mechanism

The longitudinal sealing mechanism 30 seals the tubular film Ft in its longitudinal direction. Specifically, the longitudinal sealing mechanism 30 sandwiches the overlapping portion of the film F between itself and the tube 12 and in that state uses a heater (not shown in the drawings) that the longitudinal sealing mechanism 30 has to heat-seal the overlapping portion of the film F.

The longitudinal sealing mechanism 30 is disposed in front of the tube 12. The longitudinal sealing mechanism 30 is disposed under the former mechanism 3. More specifically, the longitudinal sealing mechanism 30 is disposed under the former base 13 of the former mechanism 3.

(1-4) Transverse Sealing Mechanism

The transverse sealing mechanism 40 is disposed under the former mechanism 3. More specifically, the transverse sealing mechanism 40 is disposed under the former base 13 of the former mechanism 3. The transverse sealing mechanism 40 is disposed under the longitudinal sealing mechanism 30.

The transverse sealing mechanism 40 transversely seals the tubular film Ft to make bags B containing the product P fed from the product feed chute 15. Specifically, the transverse sealing mechanism 40 pinches, between a pair of sealing jaws 42 having built-in heaters, the tubular film Ft in a state in which the product P has been fed to the bottom portion of the tubular film Ft and heat-seals the tubular film Ft along a direction orthogonal to the conveyance direction to make the bags B containing the product P.

One of the sealing jaws, of the pair of sealing jaws 42 that seal the tubular film Ft, has a built-in cutter (not shown in the drawings). The transverse sealing mechanism 40, when transversely sealing the tubular film Ft, uses the cutter to cut the tubular film Ft at the height direction middle position of the portion transversely sealed by the sealing jaws 42, thereby cutting the bag B containing the product P away from the trailing tubular film Ft.

(1-5) First Partition Member

The first partition member 10 inhibits tiny matter such as seasoning from falling onto devices disposed under the former mechanism 3, namely, the longitudinal sealing mechanism 30 and the transverse sealing mechanism 40.

The first partition member 10 is disposed between the former 14 and the longitudinal sealing mechanism 30 in the up and down direction. The first partition member 10 vertically partitions a space around the former mechanism 3 into a first space S1 on the product feed chute 15 side and a second space S2 on the transverse sealing mechanism 40 side. The first space S1 is a space extending from the upper end of the product feed chute 15 to the undersurface of the former base 13. The second space S2 is a space extending from the lower end of the former base 13 to the lower end of the bagmaking and packaging apparatus 100.

The first partition member 10 is a tabular member. The first partition member 10 extends horizontally in the front, rear, left, and right directions around the former mechanism 3. The left and right direction width of the first partition member 10 is equal to the left and right direction width of the bagmaking and packaging apparatus 100. Furthermore, the first partition member 10 extends from the front end of the bagmaking and packaging apparatus 100 to the front end of the film supply mechanism 5. The upper surface of the first partition member 10 is flat.

In the front portion of the first partition member 10, there is a through hole (not shown in the drawings) running vertically through the first partition member 10, and the tube 12 of the former mechanism 3 is inserted into this through hole. It is preferred that the shape and size of the through hole be selected in such a way that the through hole is entirely covered by the former base 13 of the former mechanism 3 as viewed from above. The upper surface of the first partition member 10 and the undersurface of the former base 13 contact each other without any gap between them in the up and down direction.

The material of the first partition member 10 is not particularly limited, and, for example, may be stainless steel.

(1-6) Cover

The cover 16 prevents, from the standpoint of safety, workers from touching the sealing mechanisms and the like. The cover 16 surrounds the former mechanism 3 and extends from the upper end portion of the former mechanism 3 to near the upper end portion of the transverse sealing mechanism 40. Specifically, the cover 16 is disposed along, and covers, the front side, the right side, and the left surface of the first partition member 10. Panels forming the cover 16 are disposed in a vertical direction relative to the first partition member 10. The material of the cover 16 is not particularly limited and, for example, may be resin.

Hereinafter, the portion of the cover 16 that covers the front side of the former mechanism 3 will be called a front side cover D1, the portion that covers the right side of the former mechanism 3 will be called a right side cover D2, and the portion that covers the left side of the former mechanism 3 will be called a left side cover (not shown in the drawings).

The right side cover D2 is provided with a portion that does not cover the former mechanism 3, namely, an opening C. The opening C extends from the rear end of the former base 13 to the rear end of the first partition member 10 as viewed from the side. The opening C is an opening for cleaning the first partition member 10.

Multiple small holes 16*b* are formed in the lower portions of the front side cover D1, the right side cover D2, and the left side cover.

The right side cover D2 has a door 16*a*. The entire right side cover D2 may also be configured to serve as the door 16*a*.

A part 50 of the first partition member 10 is attached to the door 16*a*. More specifically, the right-side front portion of the first partition member 10 is provided on the door 16*a*. For that reason, when the door 16*a* is opened, the right-side front portion of the first partition member 10 moves together with the door 16*a* to expose the entire former mechanism 3.

(1-7) Film Supply Mechanism

The film supply mechanism 5 holds a film roll R1 in which the sheet-like film F is wound and supplies to the former mechanism 3 the film F paid out from the film roll R1.

The film supply mechanism 5 is provided adjacent to, and on the rear side of, the former mechanism 3 and supplies the sheet-like film F to the former mechanism 3. The film supply mechanism 5 includes multiple rollers 170 and a tension adjustment mechanism 180.

The film supply mechanism 5 supplies to the former mechanism 3 the film F paid out from the film roll R1. The film roll R1 is supported on a support shaft 114.

The film F paid out from the film roll R1 disposed in a film supply position is guided by the rollers 170 disposed along a predetermined film conveyance path in the film supply mechanism 5 and is conveyed to the former mechanism 3.

The tension adjustment mechanism 180, which adjusts the magnitude of the tension acting on the conveyed film F, is provided on the film conveyance path in the film supply mechanism 5.

(1-8) Control Unit

The control unit 4 is disposed under the film supply mechanism 5. The control unit 4 controls the operations of the various configurations of the bagmaking and packaging apparatus 100.

The control unit 4 has, for example, a CPU, storage units such as a main storage unit and an auxiliary storage unit, an input/output device, and various electrical circuits and electronic circuits. The control unit 4 controls the operations of each part of the former mechanism 3 and the film supply mechanism 5 as a result of the CPU reading and executing programs stored in a memory.

Specifically, the control unit 4 is electrically connected to, and controls the operations of, the film conveyance mechanism 20, the longitudinal sealing mechanism 30, and the transverse sealing mechanism 40 of the former mechanism 3.

(1-9) Second Partition Member

The second partition member 60 inhibits tiny matter such as seasoning from falling onto devices disposed under the film supply mechanism 5, namely, the control unit 4.

The second partition member 60 is disposed above the control unit 4. The second partition member 60 vertically partitions the second space between the film supply mechanism 5 and the control unit 4 into a third space S3 on the film supply mechanism 5 side and a fourth space S4 on the control unit 4 side.

The second partition member 60 is tabular. The second partition member 60 extends horizontally in the front, rear, left, and right directions in the rear portion of the bagmaking and packaging apparatus 100. The left and right direction width of the second partition member 60 is equal to the left and right direction width of the bagmaking and packaging apparatus 100. The second partition member 60 extends from the front end of the film supply mechanism 5 to the rear end of the control unit 4.

The front end of the second partition member 60 is coupled to the rear end of the first partition member 10. The second partition member 60 is disposed in a lower position than the first partition member 10. Namely, the second partition member 60 is disposed between the first partition member 10 and the control unit 4. Between the second partition member 60 and the first partition member 10, there is a step. The step may be a slope.

The upper surface of the second partition member 60 is flat.

The material of the second partition member 60 is not particularly limited and, for example, may be stainless steel.

(2) Cleaning Work

Tiny matter such as seasoning particles falls from the connecting part between the combination weigher and the former mechanism 3. When cleaning the bagmaking and packaging apparatus 100, a worker inserts through the opening C in the cover 16 a tube or the like that blows out high-pressure air and, using the air blown out from the tube, blows away the tiny matter on the first partition member 10.

(3) Characteristics (3-1)

Units disposed under the former mechanism 3, namely, the longitudinal scaling mechanism 30 and the transverse sealing mechanism 40, have a relatively complex structure. For that reason, when tiny matter such as seasoning particles sticks to the units, it is difficult to clean them. Furthermore, when such tiny matter sticks to the units, sealing defects and mechanical failures may occur.

The bagmaking and packaging apparatus 100 serving as an example of the bagmaking and packaging apparatus pertaining to the claimed invention includes the film conveyance mechanism 20, the former mechanism 3, the transverse sealing mechanism 40, and the first partition member 10. The film conveyance mechanism 20 conveys the film F. The former mechanism 3 includes the product feed chute 15 and the former 14. The product feed chute 15 has the product P fed to it. The former 14 forms in a tubular shape the film F conveyed by the film conveyance mechanism 20. The transverse sealing mechanism 40 is disposed under the former mechanism 3. The transverse sealing mechanism 40 transversely seals the tubular film Ft to make the bags B containing the product P fed from the product feed chute 15. The first partition member 10 partitions the space around the former mechanism 3 into the first space S1 and the second space S2. The first space S1 is on the product feed chute 15 side. The second space S2 is on the transverse sealing mechanism 40 side.

The bagmaking and packaging apparatus 100 has the first partition member 10 that partitions the space around the former mechanism 3 into the first space S1 and the second space S2. For that reason, tiny matter can be inhibited from getting into the units disposed under the former mechanism 3. As a result, the units are less likely to become dirty, and cleanability is enhanced.

Furthermore, deposition of the tiny matter is concentrated on the first partition member 10, so one need only concentrate on cleaning the upper surface of the first partition member 10. This also enhances cleanability.

(3-2)

In the bagmaking and packaging apparatus 100, the former mechanism 3 has the former base 13. The former base 13 has the product feed chute 15 and the former 14 attached to it. The former base 13 is attached to the first partition member 10.

In this bagmaking and packaging apparatus 100, the former base 13 can be used as a reference when attaching the former mechanism 3, so it becomes easy to position the former 14 relative to the first partition member 10. Specifically, a worker grips the former base 13 and installs the former mechanism 3 so that the bottom surface of the former base 13 is along the upper surface of the first partition member 10. By moving the former base 13 horizontally on the first partition member 10, the former mechanism 3 can be installed in a predetermined position on the first partition member 10 that is an attachment surface.

(3-3)

In the bagmaking and packaging apparatus 100, the upper surface of the first partition member 10 is flat. In the bagmaking and packaging apparatus 100, there is no unevenness in the upper surface of the first partition member 10, so it is easy to perform not only cleaning by blowing the first partition member 10 with an air jet but also cleaning by wiping the first partition member 10 with a duster cloth or the like. For that reason, cleanability is enhanced.

(3-4)

Figure 3:
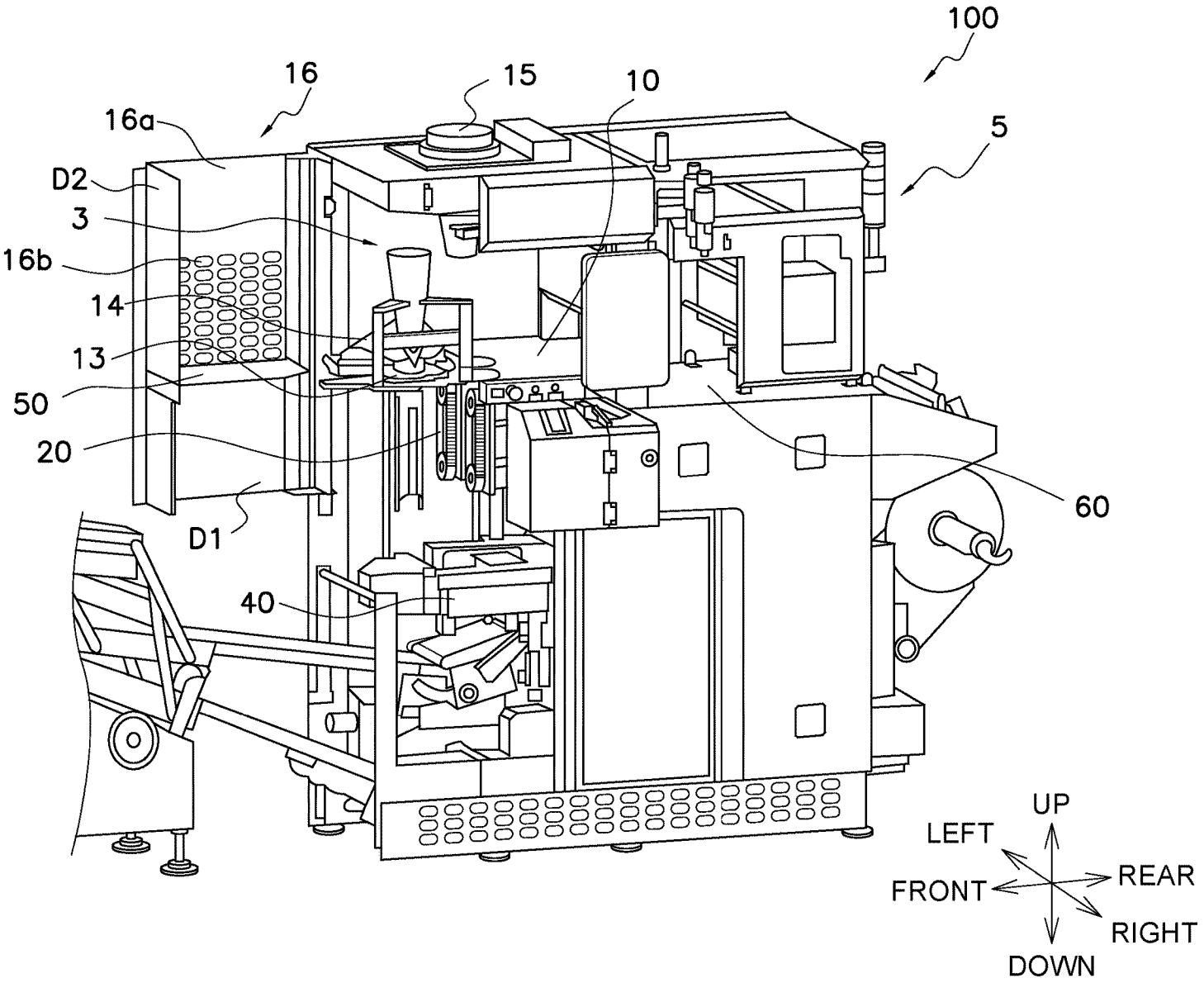
FIG. 3 is a schematic perspective view, seen from a viewpoint different from that of FIG. 1, illustrating a state in which a door of the bagmaking and packaging apparatus illustrated in FIG. 1 is open.

The bagmaking and packaging apparatus 100 further includes the cover 16. The cover 16 has the door 16*a*. The cover 16 surrounds the former mechanism 3. As shown in FIG. 3, the part 50 of the first partition member 10 is provided on the door 16*a*.

In the bagmaking and packaging apparatus 100, the part 50 of the first partition member 10 moves together with the door 16*a* to expose the entire former mechanism 3. For that reason, there is nothing to get in the way when detaching and attaching the former mechanism 3, and it is easy to detach and attach the former mechanism 3. Furthermore, it is easy to access the area around the former mechanism 3, and cleanability is enhanced.

(3-5)

As shown in FIG. 1, in the bagmaking and packaging apparatus 100, the cover 16 is provided with the opening C.

In the bagmaking and packaging apparatus 100, the first partition member 10 can be cleaned through the opening C.

(3-6)

As shown in FIG. 1 and FIG. 2, the bagmaking and packaging apparatus 100 further includes the film supply mechanism 5. The film supply mechanism 5 holds the film roll R1 and supplies the film F. The control unit 4 is disposed under the film supply mechanism 5. The bagmaking and packaging apparatus 100 has the second partition member 60. The second partition member 60 partitions the second space S2 between the film supply mechanism 5 and the control unit 4 into the third space S3 and the fourth space S4. The third space S3 is on the film supply mechanism 5 side. The fourth space S4 is on the control unit 4 side.

In the bagmaking and packaging apparatus 100, seasoning particles can be prevented from falling onto the control unit 4.

(3-7)

In the bagmaking and packaging apparatus 100, the upper surface of the second partition member 60 is flat.

In the bagmaking and packaging apparatus 100, there is no unevenness in the upper surface of the second partition member 60, so cleanability is enhanced.

(4) Example Modifications

Example modifications of the embodiment will be described below. The example modifications may be appropriately combined to the extent that they are not mutually contradictory.

(4-1) Example Modification A

In the above embodiment, the upper surface of the first partition member 10 is flat, but it is not particularly limited to this. The upper surface of the first partition member 10 may, for example, be a curved surface.

Likewise, the upper surface of the second partition member 60 is also not limited to being flat.

(4-2) Example Modification B

In the above embodiment, the first partition member 10 is horizontally disposed, but it is not particularly limited to this. The first partition member 10 may, for example, be inclined from left to right. In this case, when a worker stands on the right side of and cleans the bagmaking and packaging apparatus 100, it is easy for the worker to clean off and collect tiny matter such as seasoning particles on the right side.

Likewise, the second partition member 60 is also not limited to being horizontally disposed.

(4-3) Example Modification C

In the above embodiment, a step is provided between the first partition member 10 and the second partition member 60, but the first partition member 10 and the second partition member 60 are not particularly limited to this. The first partition member 10 and the second partition member 60 may also be flush with each other. Namely, instead of installing the second partition member 60, the first partition member 10 may be extended rearward. In this case, cleanability is excellent.

Furthermore, the second partition member 60 and the first partition member 10 may be coupled to each other in a state in which the height of the upper surface of the front end of the second partition member 60 and the height of the upper surface of the rear end of the first partition member 10 are made the same, and the second partition member 60 may be inclined rearward.

(4-4) Example Modification D

Figure 4:
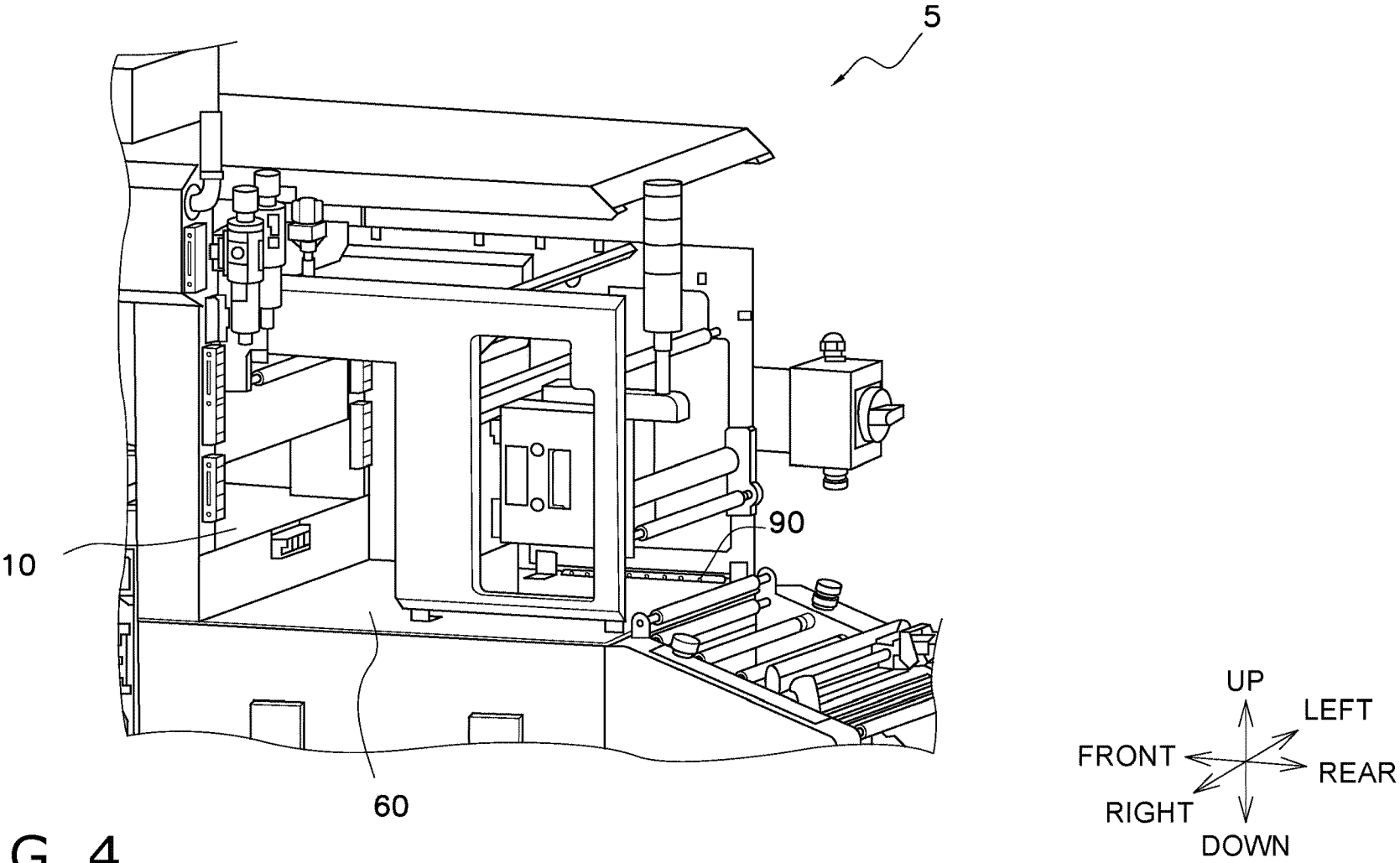
FIG. 4 is an enlarged perspective view of the rear portion of the bagmaking and packaging apparatus illustrated in FIG. 1.

The above embodiment assumes that the bagmaking and packaging apparatus 100 is manually cleaned, but the bagmaking and packaging apparatus 100 is not particularly limited to this. As shown in FIG. 4, the bagmaking and packaging apparatus 100 may further include air outlets 90 for cleaning. In this case, automatic cleaning becomes possible.

The method of forming the air outlets 90 for cleaning is not particularly limited. The air outlets 90 for cleaning may, for example, be formed by disposing a tube for an air jet on the second partition member 60. The air jet may be controlled from the bagmaking and packaging apparatus 100 and made to execute a program such as cleaning at regular intervals or a cleaning mode. It will be noted that the air outlets 90 may also be disposed on the first partition member 10.

(4-5) Example Modification E

In the above embodiment, the cover 16 also covers a range above the first partition member 10 and the second partition member 60, but the range covered by the cover 16 is not limited to this. The cover 16 may also be configured to cover just a range under the first partition member 10 and the second partition member 60. Because of this, it becomes even easier to access the first partition member 10 and the second partition member 60, and cleanability is improved. It will be noted that in this case also, areas that pose a danger if the worker were to get caught in them, such as the transverse sealing mechanism 40 for example, are covered, and safety is ensured. Furthermore, two bagmaking and packaging apparatus 100 of the embodiment may be installed in parallel, and the gap between them may be closed by spacers of the same heights as the first partition member 10 and the second partition member 60, so that, for example, a worker can stand on the right side of one bagmaking and packaging apparatus 100 and clean off tiny matter such as seasoning particles at one time toward the left side of the other bagmaking and packaging apparatus 100, so that cleaning efficiency can be improved.

INDUSTRIAL APPLICABILITY

The claimed invention is useful as a bagmaking and packaging apparatus that has excellent cleanability.

REFERENCE SIGNS LIST

3 Former Mechanism
4 Control Unit
5 Film Supply Mechanism
10 First Partition Member
13 Former Base
14 Former

15 Product Feed Chute
16 Cover
16*a* Door
20 Film Conveyance Mechanism
40 Transverse Sealing Mechanism
60 Second Partition Member
90 Air Outlets
100 Bagmaking and Packaging Apparatus
B Bags
C Opening
F Film
P Product
R1 Film Roll
S1 First Space
S2 Second Space
S3 Third Space
S4 Fourth Space

CITATION LIST

Patent Literature

Patent Document 1: JP-A No. 2002-337817

The invention claimed is:

1. A bagmaking and packaging apparatus, comprising:

a film conveyance mechanism configured to convey a film;

a former mechanism including a product feed chute to which a product is to be fed and a former configured to form the film into a tubular shape, the film to be conveyed by the film conveyance mechanism;

a transverse sealing mechanism disposed under the former mechanism and being configured to transversely seal the tubular film to make bags containing the product that has been fed from the product feed chute;

a first partition member partitioning a space around the former mechanism into a first space on the product feed chute side and a second space on the transverse sealing mechanism side; and a cover having a door with the cover surrounding the former mechanism in a vertical direction;

wherein a part of the first partition member is attached to the door, and the part of the first partition member moves together with the door.

2. The bagmaking and packaging apparatus of claim 1, wherein the former mechanism has a former base to which the product feed chute and the former are attached and the former base is attached to the first partition member.

3. The bagmaking and packaging apparatus of claim 1, wherein an upper surface of the first partition member is flat.

4. The bagmaking and packaging apparatus of claim 1, wherein the cover has an opening.

5. The bagmaking and packaging apparatus of claim 1, further comprising air outlets for cleaning.

6. The bagmaking and packaging apparatus of claim 1, further comprising a film supply mechanism configured to hold a film roll and to supply the film, wherein a control unit is disposed under the film supply mechanism, and the bagmaking and packaging apparatus has a second partition member partitioning the second space between the film supply mechanism and the control unit into a third space on the film supply mechanism side and a fourth space on the control unit side.

7. The bagmaking and packaging apparatus of claim 6, wherein an upper surface of the second partition member is flat.

8. The bagmaking and packaging apparatus of claim 6, wherein the cover is configured to cover a range under the first partition member and the second partition member.

* * * * *